United States Patent [19]

Knauff

[11] 4,271,378

[45] Jun. 2, 1981

[54] TOY WITH REVERSIBLE DRIVEN HOIST

[76] Inventor: Robert J. Knauff, 819 N. Gardner St., W. Hollywood, Calif. 90046

[21] Appl. No.: 973,896

[22] Filed: Dec. 28, 1978

[51] Int. Cl.[3] ..... H02P 15/00

[52] U.S. Cl. ..... 318/10; 74/202; 46/248; 46/251

[58] Field of Search ..... 74/202, 203, 204, 218, 74/220, 353, 361, 376, 404, 776, 780, 784, 785, 792; 318/10; 46/227, 230, 251, 248, 249

[56] References Cited

U.S. PATENT DOCUMENTS

| | | | |
|---|---|---|---|
| 751,878 | 2/1904 | Spangler | 74/202 |
| 807,176 | 12/1905 | King | 74/202 |
| 906,931 | 12/1908 | Sohn et al. | 74/202 |
| 2,468,453 | 4/1949 | Mallentoer | 74/202 |
| 2,618,161 | 11/1952 | Mason | 74/202 |
| 3,389,317 | 6/1968 | Prewitt | 318/325 |
| 3,481,213 | 12/1969 | Macchia | 74/202 |
| 3,896,914 | 7/1975 | Konsbruck | 318/10 |

*Primary Examiner*—David Smith, Jr.

*Attorney, Agent, or Firm*—William H. Maxwell; Willis J. Higgins

[57] ABSTRACT

A simplified reversible drive especially adapted for models and toys, utilizing two parallel and spaced apart drive discs with opposing faces rotating together in tandem, a third reversibly driven disc disposed between and perpendicular to the pair of discs, and means to selectively bias the third disc against either one of the said opposing disc faces to produce selected rotation in one direction, and against the other opposing face to produce selected rotation in the other direction, all of which is easily assembled by a hobbyist, without the use of special tools, and incorporating in a light and/or sound effect producing circuit including a motor for rotating the drive discs, a background sound effect and lighting effect producing circuit element connected in series with the armature of the motor, and a normally open magnetically operated switch which is periodically closed by a magnet mounted on one of the discs to produce punctual sound effects.

5 Claims, 5 Drawing Figures

TOY WITH REVERSIBLE DRIVEN HOIST

BACKGROUND OF THE INVENTION

1. Field of the Invention

This invention relates to a simplified reversible drive and an effect producing circuit incorporating the drive. More particularly, it relates to such a drive and circuit which are especially adapted for use in models and toys. Most especially, it relates to such a drive and circuit which may be provided in kit form to a hobbyist for assembly, typically together with a model kit. The effect producing circuit incorporating the drive is related to my earlier, copending application Ser. No. 931,551, filed Aug. 7, 1978 and entitled "Low Cost Electromechanical Simulation Circuits." Specifically, while the circuits there disclosed utilize two pole motors, the present circuit can and preferably utilizes motors with three or more poles. Because the circuits disclosed in the above-referenced application utilize two pole armature motors, a mechanical start is required for them.

2. Description of the Prior Art

The need for a reversible drive for models and toys is a common one. There are many situations in which it is desirable to reverse the rotation of a part in a model or toy. There are also many situations in which a part of a model or toy is to be raised and then lowered in operation.

There are a substantial variety of reversible drive mechanisms known in the art. For example, *Jones, Ingenious Mechanisms for Designers and Inventors* (New York Industrial Press, 1930), chapter 5, pages 161–197, especially FIG. 1, and chapter 11, FIG. 11, disclose typical prior art reversible drive mechanisms. While there is a well-developed body of prior art on such mechanisms, a need still remains for a simplified reversible drive mechanism especially adapted for use in models and toys.

SUMMARY OF THE INVENTION

Accordingly, it is an object of this invention to provide a reversible drive of simplified construction especially adapted for use in models and toys.

It is another object of the invention to provide such a reversible drive which may be easily assembled by a hobbyist without the use of special tools.

It is a further object of the invention to provide a reversible drive for models and toys which can also be used to activate electrical circuit elements in the models and toys.

It is still another object of the invention to provide a low-cost drive for raising and lowering a hoist on a model or toy tow truck.

It is yet another object of the invention to provide an electromechanical circuit for producing light, sound and similar effects in models and toys which utilizes an electric motor having three or more poles in its armature to generate electrical signal variations utilized to produce the effects.

It is a still further object of the invention to provide an electromechanical circuit for producing light, sound and similar effects in models and toys in which a self-starting electrical motor may be used both to produce the effects and provide motion for at least a portion of the model or toy incorporating the circuit.

The attainment of these and related objects is achieved through use of the reversible drive, circuit and model or toy incorporating the drive and circuit herein disclosed. A reversible drive in accordance with the invention has first and second spaced apart parallel plates or discs fixedly mounted on a first rotatable shaft. Each disc has a face opposing a face of the other. A third disc having an edge around its circumference is fixedly mounted on a second rotatable shaft. The third disc is positioned between the parallel discs and perpendicular to the opposing faces of them. A means is provided for selectively biasing the third disc against one of the opposing faces of the spaced apart plates or discs so as to produce rotary motion in a first direction, and for biasing the third disc against the other opposing face of the spaced apart plates or discs for producing rotary motion in the opposite direction. An electric motor or other suitable means imparts rotary motion to one of the rotatable shafts, preferably to the said first rotatable shaft and the other rotatable shaft is driven through use of the present mechanism.

In a preferred form of the drive, a means is provided for centering the third disc between the spaced apart plates or discs when it is not being biased against one of the opposing faces thereof. In an especially preferred form of the invention, the centering means includes a portion of the first rotatable shaft between the two parallel plates or discs, a portion of reduced diameter and with a compressed spring for biasing the second shaft against said portion of the first shaft. The compressed spring is carried by a lever connected at one end of the second rotatable shaft and having a fulcrum remote from that end. This lever serves as the means for biasing the third disc against the parallel plates or discs.

A circuit in accordance with the invention includes a motor having more than two poles in the armature, which is therefore self-starting. A background effect producing circuit element is connected in series with the armature of the motor. A punctuating effect circuit element is connected in parallel with the effect producing circuit element preferably in the form of a normally open reed switch positioned proximate to one of the first and second discs of the reversible drive and periodically closed by rotation of said drive, or by means of a magnet mounted on the disc.

The attainment of the foregoing and related objects, advantages and features of the invention should be more readily apparent after review of the following more detailed description of the invention, taken together with the drawings, in which:

DETAILED DESCRIPTION OF THE INVENTION

Figure 1:
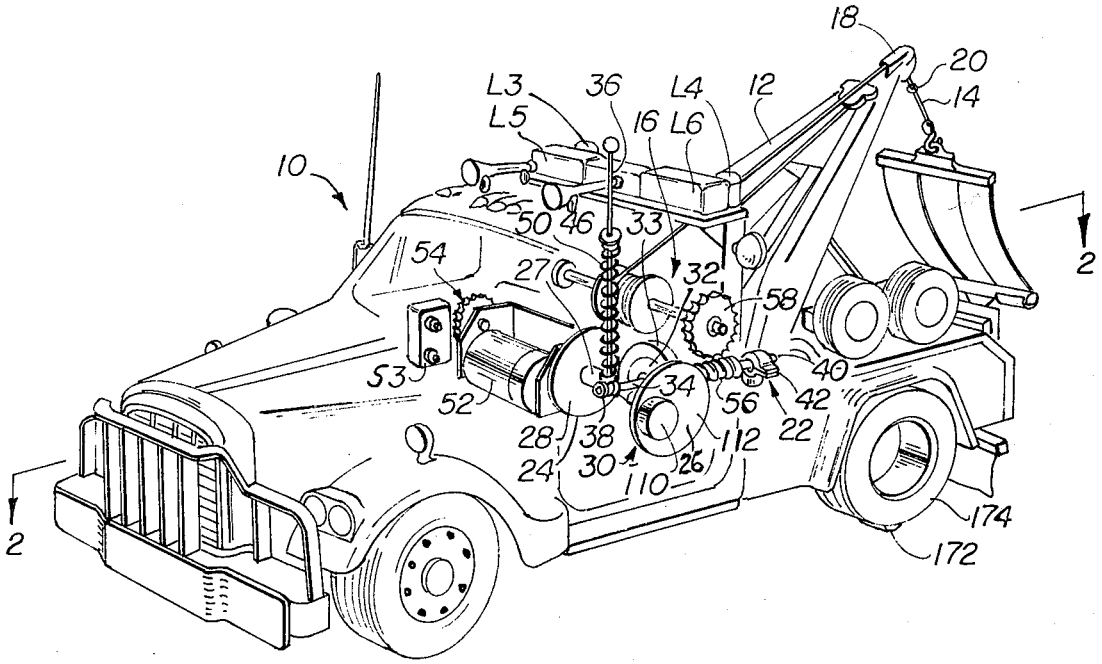
FIG. 1 is a perspective ghost view of a model tow truck incorporating a reversible drive in accordance with the invention.
Figure 2:
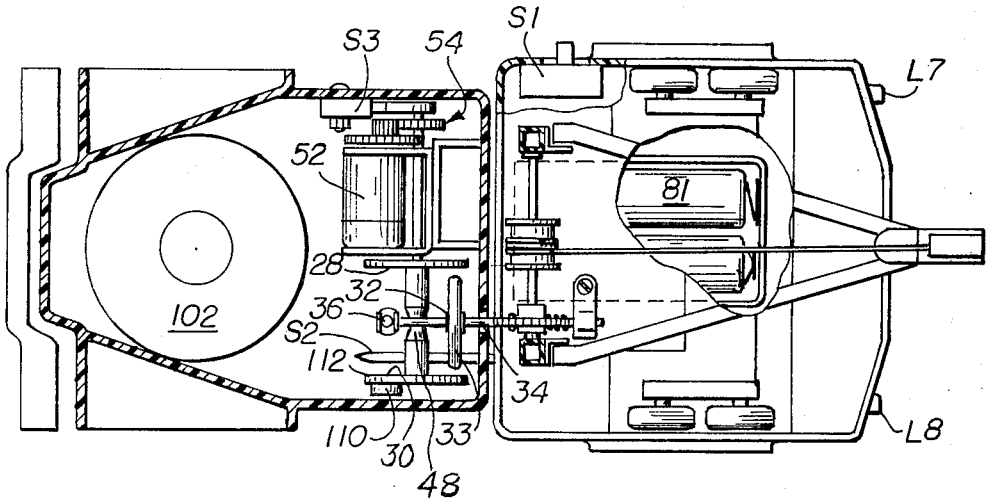
FIG. 2 is a top view taken along the line 2—2 in FIG. 1.

Turning now to the drawings, more particularly to FIGS. 1 and 2, there is shown an assembled model incorporating a reversible drive in accordance with the invention. The reversible drive and model are typcially provided in kit form for assembly by a hobbyist. Model truck 10 includes a moveable boom 12 with a tow cable 14. Winch 16 is rotated in one direction to shorten the cable 14 and is rotated in the other direction to lengthen the cable. Cable 14 passes through aperture 18 in the boom 12. Cable 14 has a knot 20 or other enlarged portion which will not pass through the aperture 18. Boom 12 is pivotally mounted on the truck as indicated at 22. Thus, shortening cable 14 through use of winch 16 will raise the boom 12 when the knot 20 reaches aperture 18.

The present reversible drive mechanism provides the necessary rotary motion to winch 16 for shortening and lengthening the cable 14. The mechanism includes first and second spaced apart parallel discs 24 and 26 fixedly mounted on rotatable shaft 27. The first and second discs 24 and 26 have opposing faces 28 and 30, respectively. A third disc 32 is fixedly mounted on rotatable shaft 34. The third disc 32 is positioned as shown between the two opposing faces 28 and 30 on first and second discs 24 and 26 and perpendicular to them. The discs 24 and 26 are desirably fabricated of plastic, e.g., polystyrene. At least edge 33 of third disc 32 is desirably rubber or another resilient material in order to promote slip free engagement of edge 33 with faces 28 and 30.

Lever 36 is fastened to end 38 of shaft 34 so that the shaft 34 is free to rotate. End 40 of shaft 34 is loosely mounted in fitting 42 so that shaft 34 may be pivoted sufficiently to move edge 33 against faces 28 and 30 by means of lever 36. Lever 36 passes through rubber grommet 46, thus providing a fulcrum for it.

Shaft 27 has a portion 48 of concavely reduced diameter between the two discs 24 and 26. Compressed spring 50 is carried by lever 36 and serves to bias shaft 34 into the portion 48 of reduced diameter of shaft 27 when lever 36 is not biasing edge 33 of third disc 32 against either face 28 or 30 of the first and second discs 24 and 26. Motor 52 rotates shaft 27 through gears 54 coupling the motor to the shaft. Worm gear 56 on shaft 34 engages gear 58 to drive winch 16. Use of such a worm gear drive additionally provides a position brake for the boom 12, preventing a force applied to cable 14 from moving the boom, except through use of the drive mechanism.

Figure 3:
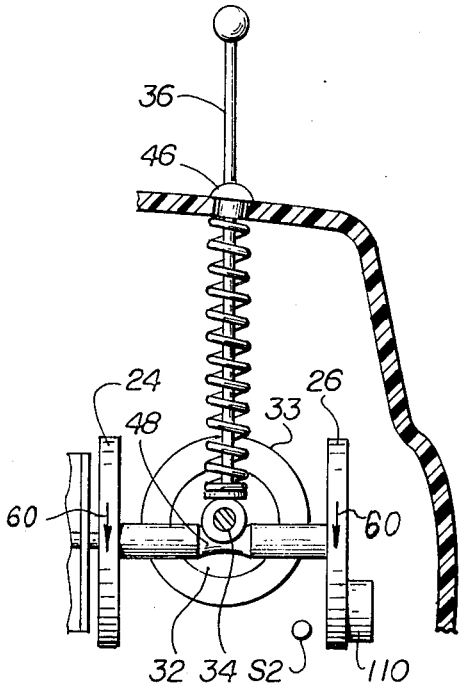
FIG. 3 is a front view of the reversible drive shown in FIG. 1.
Figure 4:
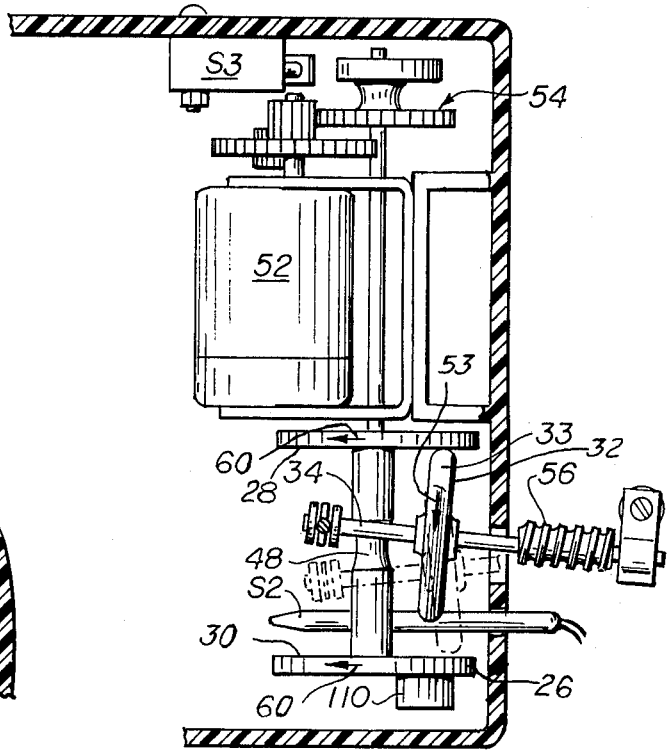
FIG. 4 is an enlarged view of a portion of FIG. 2, with a phantom view to show operation of the reversible drive in FIGS. 1–3.

The operation of the drive mechanism will now be explained, with reference to FIGS. 3 and 4 as well as FIGS. 1 and 2. Motor 52 rotates discs 24 and 26 in a counter-clockwise direction, as indicated by arrows 60 (FIGS. 3 and 4). As is shown in FIG. 4, in order to shorten cable 14 and raise boom 12, lever 36 biases edge 33 of third disc 32 against face 28 of first disc 24, thus causing disc 32 to rotate in a clockwise direction as shown by arrow 53 in FIG. 4. In order to lengthen cable 14 and lower boom 12, lever 36 is used to bias edge 33 of third disc 32 against face 30 of second disc 26, thus causing disc 32 to rotate in a counter-clockwise direction. It should be noted that first and second discs 24 and 26 need not be circular in shape since their edges do not rotate against another element, as does edge 33 of third disc 32.

Figure 5:
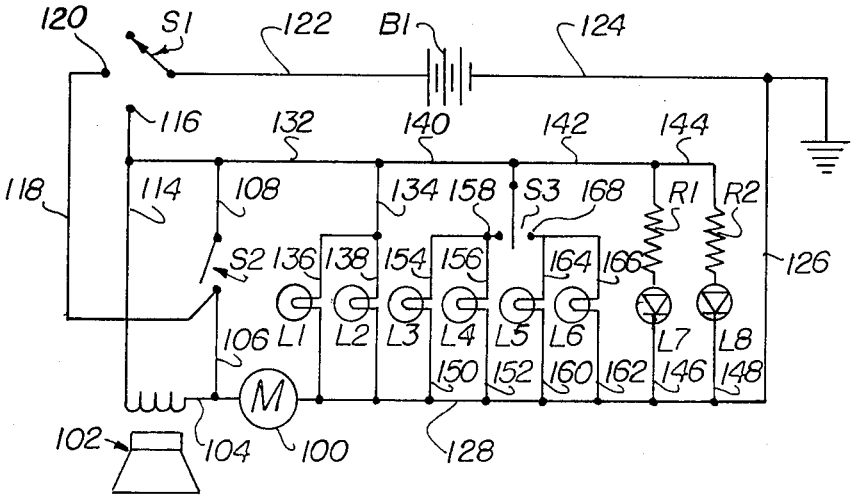
FIG. 5 is a schematic diagram of an electrical circuit for use in a model with the drive of this invention.

The drive mechanism of FIGS. 1–4 is most advantageously employed with the circuit shown in FIG. 5 to produce light and sound effects for the truck shown in FIG. 1. Motor 100 having a multiplicity of poles is a commercially available Mabuchi three pole model FA 13 motor. Speaker 102 is connected in series with motor 100 by line 104. Normally open single pole, single throw reed switch S2 is connected in parallel to speaker 102 by lines 106 and 108. As shown in FIGS. 2–4 reed switch S2 is positioned proximate to face 30 of second disc 26. Magnet 110 is mounted on the other face 112 of the second disc 26 so that the magnet passes by the reed switch S2 once for each revolution of the disc 26, thus closing the switch S2 for the time that the magnet 110 is opposite the switch S2. Speaker 102 is connected to single pole three position switch S1 by means of line 114 to contact 116 of switch S1. Line 118 connects motor 100 directly to contact 120 of switch S1 to bypass speaker 102. Switch S1 is connected to battery B1 by line 122. Lines 124, 126, and 128 connect the other terminal of battery B1 to motor 100.

Lines 132, 134, 136 and 138 serve to connect parallel headlights L1 and L2 in the circuit. Line 140 is connected to 50% duty cycle single pole double throw switch S3 and, by a line 142 and 144 to light emitting diodes (LEDs) L7 and L8. LEDs L7 and L8 are ballasted by resistors R1 and R2, serve as the tail lights of the model truck as shown in FIG. 2, and are connected to line 128 by lines 146 and 148.

Red lights L3 and L4 are connected to line 128 by lines 150 and 152, respectively. Lines 154 and 156 connect ights L3 and L4 to terminal 158 of switch S3. Lines 160 and 162 connect amber lights L5 and L6 to line 128, and lines 164 and 166 connect L5 and L6 to terminal 168 of switch S3.

In operation, with switch S1 engaging contact 116, motor 100 runs at a first relatively low RPM rate, due to the resistance of speaker coil (speaker 102). Since motor 100 is a three pole motor, it is self-starting, but such a three pole motor does not produce sufficient currnt spikes as its armature rotates to produce accentuated sounds in speaker 102, only background noise. However, magnet 110 (FIGS. 1–4 closes reed switch S2 once for each revolution of disc 30. When switch S2 is closed, speaker 102 is bypassed in the circuits, and when switch S2 is open, current flow resumes in speaker 102. The resulting current surges produce a strong popping noise in speaker 102, a punctuation which when combined with the slight background sounds produced in speaker 102 by making and breaking commutator contacts due to rotation of the armature of motor 100, produce a highly realistic simulated internal combustion engine noise. As switch S2 opens and closes and motor 100 rotates, the resulting current surges also produce a flickering of lights L1–L8. Switch S3 serves to flash the red lights L3–L4 and the amber lights L5–L6 alternately. When switch S1 engages contact 120, speaker 102 is bypassed out of the motor circuit, causing motor 100 to run at a substantially higher speed. The flickering and/or flashing of the lights L1–L8 continues at the higher speed, but somewhat dimmer in intensity since the lights L1–L8 are in series with speaker 102 when S1 engages contact 120 and S2 is open.

The presence of magnet 110 on rotating disc 30 produces an imbalance which causes the model to rock slightly as disc 30 rotates. This effect may be made more noticeable by providing a rivet 172 on the bottom of wheel 174 (which does not rotate), thus providing a slight instability of the model as its rests on its wheels.

It should now be apparent that a reversible drive mechanism and effect producing circuit for a model or toy capable of achieving the stated objects of the invention has been provided. The reversible drive is of simplified construction and is easily assembled by a hobbyist without special tools. The circuit incorporating the reversible drive uses a self-starting three or more pole armature motor, yet is capable of producing realistic sound effects and light effects in a model or toy. These desirable results achieved through use of the present reversible drive and effect circuit should result in wide utilization of the drive and circuit in models and toys.

It should further be apparent to those skilled in the art that various changes in form and details may be made in the invention as described above. It is intended that such modifications be included within the spirit and scope of the claims appended hereto.

What is claimed is:

1. A reversible drive for a model or toy, which comprises:

a first rotatable shaft having a central reduced diameter;

a motor coupled to rotate said first rotatable shaft;

a pair of spaced apart drive discs fixedly mounted on said first rotatable shaft and having parallel opposed faces embracing said central reduced diameter thereof;

a second rotatable shaft disposed at a right angle to said first rotatable shaft and having a loosely mounted end remote from said first rotatable shaft;

a driven disc fixedly mounted on said second rotatable shaft in a plane at a right angle to said parallel spaced apart drive discs;

a lever for selectively biasing the circumferential edge of said driven disc against one of the opposed faces of said drive discs in one direction of rotation, and against the other opposing face of said drive discs to drive said driven disc in the opposite direction, said lever being pivotally connected to said second rotatable shaft remote from the loosely mounted end of said second shaft;

a fulcrum for said lever remote from said second rotatable shaft;

and means for pivotally biasing the loosely mounted second rotatable shaft having said driven disc mounted thereon into centered engagement with said central reduced diameter portion of said first rotatable shaft.

2. The reversible drive of claim 1 in which the central reduced diameter of said first rotatable shaft is of concavely reduced configuration between said drive discs, said lever carrying a compressed spring for biasing said second rotatable shaft into said central concavely reduced diameter to center the driven disc out of engagement against either of said drive discs.

3. The reversible drive of claim 1 additionally comprising a worm fixedly mounted proximate to the loosely mounted end of said second shaft to pivot therewith, and a gear rotatable on a fixed axis and engaging said loosely pivoted worm for transmitting motion to at least a portion of the model toy incorporating said drive.

4. The reversible drive of claim 3 in which the portion of the model toy to which the motion is transmitted is a hoist.

5. The reversible drive of claim 1 wherein the second rotatable shaft is biased against said central reduced diameter portion of the first rotatable shaft by a spring carried by said lever.

* * * * *